US005125855A

United States Patent [19]

Brooks

[11] Patent Number: 5,125,855

[45] Date of Patent: Jun. 30, 1992

[54] VEHICLE FUSE BLOCK EXTENSION

[76] Inventor: Dennis L. Brooks, 1313 Laredo St., Aurora, Colo. 80011

[21] Appl. No.: 613,052

[22] Filed: Nov. 15, 1990

[51] Int. Cl.[5] ..... H01R 13/68

[52] U.S. Cl. ..... 439/622; 337/209

[58] Field of Search ..... 439/621, 622; 337/187, 337/188, 197, 198, 209

[56] References Cited

U.S. PATENT DOCUMENTS

| | | | |
|---|---|---|---|
| 3,744,003 | 7/1973 | Dipace | 337/209 X |
| 4,372,638 | 2/1983 | Sohler | 439/621 X |
| 4,842,534 | 6/1989 | Mobley et al. | 439/622 X |
| 4,884,050 | 11/1989 | Kozel | 439/621 X |
| 4,944,697 | 7/1990 | Dorman | 439/621 |

*Primary Examiner*—Eugene F. Desmond

[57] ABSTRACT

Vehicle fuse block extenders are made up of a strip electrode, connector element and an insulating body. The strip electrode has at least one male and at least two female electrical contacts. The connector element has at least one male contact and also has at least two electrically conductive female contacts, one of the connector element electrically conductive female contacts is insulated from the male contact and the other female contact is attached to the male contact.

The male and female contacts of the strip electrode and the connector element are positioned in a compatible, side-by-side parallel relationship by the body which acts as a supporting mechanism for the electrical contacts and as an insulator for the user.

5 Claims, 2 Drawing Sheets

VEHICLE FUSE BLOCK EXTENSION

BACKGROUND OF THE INVENTION

Vehicles with electrical systems are equipped with fuse blocks for safety. Such system are not normally equipped with any mechanism for protecting electrical devices not included in the electrical system design. Historically, such devices have been attached through the cigaret lighter accessory, leaving wire trailing on or handing from various retrofitted appliances. These appliances include such things as battery chargers for cellular telephones, fans, radar detectors, power supplies, CB radios, etc.

A variety of mechanisms for adding fuses have been proposed to get away from the trailing wire problem as indicated by the following summarized patents.

U.S. Pat. No. 3,821,695 issued to L. J. Scholer teaches a means of adding a circuit to an existing cartridge-fused circuit by adding a connector that snaps over the divergent ends of the fuse holder arms. By adding an additional parallel circuit, the electrical load can be increased without additional fuse protection.

U.S. Pat. No. 4,023,884 issued to M. L. Morlan teaches a means of adding a circuit to an existing cartridge-fused circuit by providing a clip comprising a split cylinder which fits between one end of a cartridge fuse and its holder and which contains a male terminal extending at right angles to the split cylinder.

U.S. Pat. No. 4,128,291 issued to R. J. Peterson, Jr. teaches a means of adding one or more circuits to a cartridge-fused circuit by adding an adapter terminal at each end of a cartridge fuse block.

U.S. Pat. No. 4,391,485 issued to A. Urano teaches an in-line fuse holder adapted to accept blade fuses, but does not provide additional circuits.

The plug-in fuse block extension of the present invention requires no addition to or modification of the existing fuse block while allowing the addition of one or more additional parallel fuse-protected circuits. The extension need not be removed in order to remove the added fuse or fuses. Further, it is inexpensive and of minimal size. Finally, it allows the installer to place almost all, if not all, of the wiring behind the vehicle instrument panel sot hat it will not get in the way of or be damaged by the occupants.

SUMMARY OF THE INVENTION

Extenders for vehicular plug type fuse blocks are made up of an electrically conductive strip electrode, a connector element, and a non-conductive body. The strip electrode has a male and at least two female contacts. The connector element also has at least one male contact and the same number of female contacts as the strip electrode. One of the female contacts of the connector element is not electrically insulated from the male contact but the remainder are. The body maintains the strip electrode and the connector element in a side-by-side, parallel relationship where the positions of the male and female contacts of the connector element mirror the positions of the strip electrode contacts. Wire leads to accessories are connected to each of the insulated connector female contacts.

DETAILED DESCRIPTION OF THE FIGURES

Figure 1:
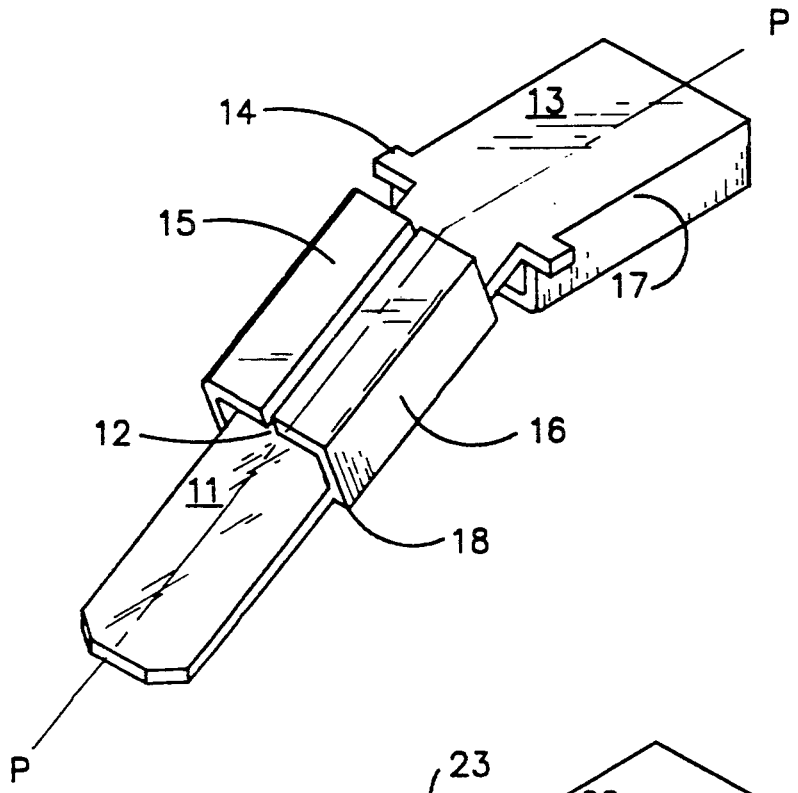
FIGS. 1–3 depict various aspects of a preferred embodiment.

FIG. 1 depicts a strip electrode made up of a male contact 11 and female contacts 12 and 13. Contact 13 has an "anchor" extension 14 for the strip electrode. Female contacts 12 and 13 are formed from extensions 15, 16, and 17 of the edges of strip 18. An additional extension opposite to extension 17 is hidden from view.

Figure 2:
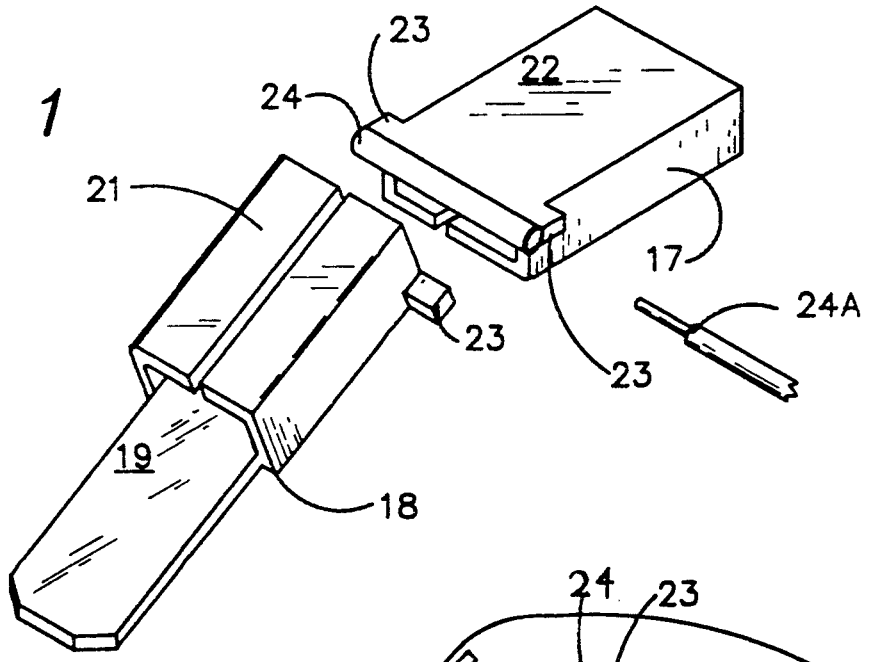

FIG. 2 shows a connector element made up of a male contact 19 and female contacts 21 and 22. Each of the contacts have an anchoring extension base 23. The female contact 22 has an attached circular tube 24 to be used to permanently connect the female contact to lead wire **24*a*** by crimping.

Figure 3:
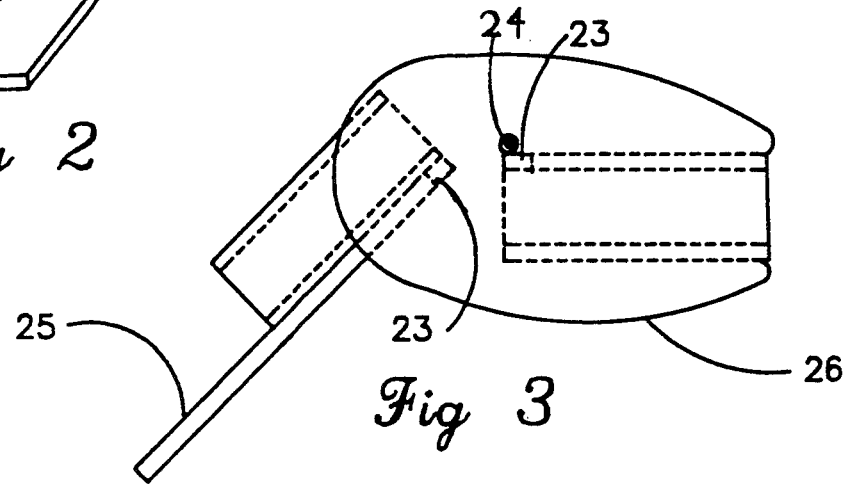

FIG. 3 is a side view of an extender with the connector element of FIG. 2 depicted, partially by dashed lines, and the strip electrode completely hidden. A polymer body 26 has been molded over the strip electrode 25 and the connector elements to fix the position of the various components and to protect the user from shock. The body 26 cannot extend down the female contact because of a lack of space for use access. However, an insulating film or coating (not shown) can be used to cover the female contact formed by extensions 17 and 18.

Figure 4:
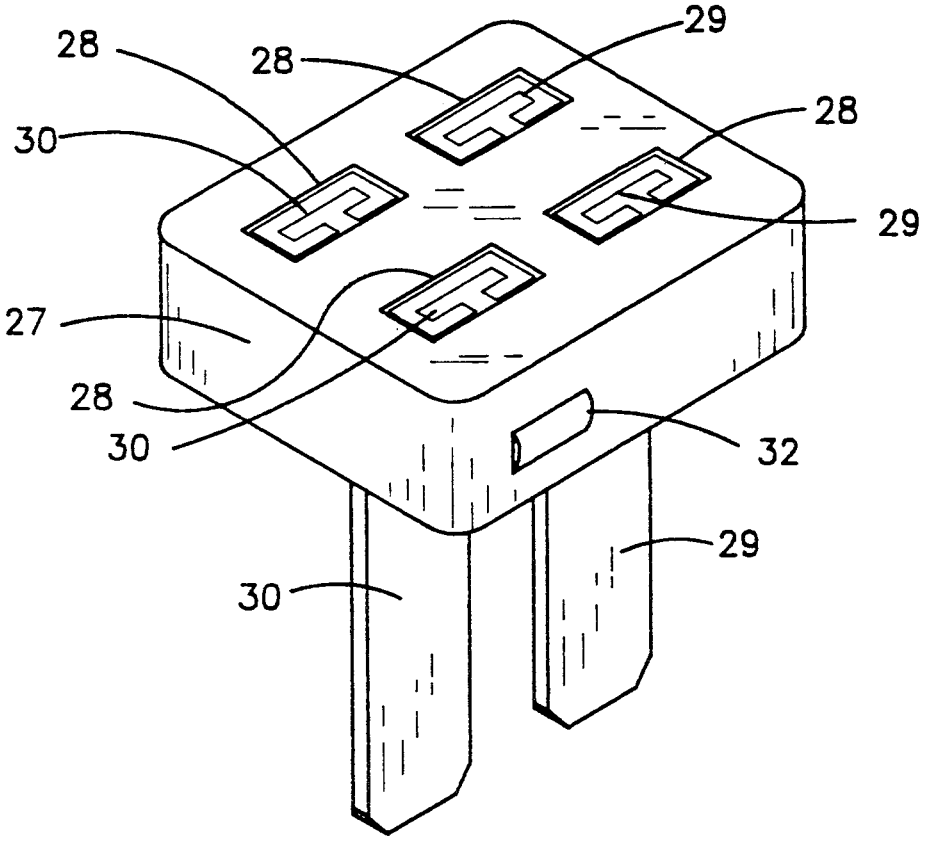
FIG. 4 shows an embodiment with female contacts in parallel.

FIG. 4 depicts a "┗┛" shaped embodiment with a flat body 27 having openings 28 in its upper surface for the contacts of strip electrode 29 and connector element 30. Body 27 also has male contacts 29 and 30 on its bottom surface. A fuse placed in contacts 29 and 30 provides the original circuit. A bus (now shown) electrically communicates between female contacts 29 enables a fuse to be placed in contacts 29 and 31 for the fuse box extension. Camming connector unit 32 is used to attach a wire lead to the female contact 31 of the connector elements.

GENERAL DESCRIPTION OF THE INVENTION

The materials utilized in vehicular electrical systems can be used to manufacture the various components of the fuse block extenders. While the Figures depict two female contacts per extender, more can be utilized. Thus, in FIG. 2 a third female contact can be positioned within an insulating body extending at an angle from the position of female contact 22. The corresponding strip electrode would, of course, have an additional female contact at the same angle. The "┗┛" strip electrode configuration can be modified, for example, to a "Y" configuration. The blade electrodes can also be "U" shaped, hollow and solid round metal prongs, octagons, etc. The connector element contacts can also have a variety of anchor forms. While lateral anchors are depicted, "Y", "T" and "L" anchor configurations and/or holes can also be utilized.

A variety of quick lock mechanisms are used to connect insulated and non-insulated wiring to electrical home and industrial male and female plugs. These mechanisms, of which camming devices are one, can be used with the appropriate connector element contacts. Additionally, the lead wire contacts can be in forms used with commercial terminal adapters, harness wiring, soldering, brazing, etc.

Accessories, as used herein, can be independently fused or non-fused. A fuse size appropriate to the accessory is sued as part of the fuse box extension. Accessories include items which can be utilized with or as part of a vehicle, e.g., a radar detector, or separately, e.g., a flashlight battery charger.

The extenders are used by connecting accessory lead wires, as needed, placing the appropriate male contacts into the female element of the vehicle fuse block and plugging in the needed fuses.

I claim:

1. The vehicle fuse block extender comprising an electrical insulator means for maintaining a strip electrode and connector element means in substantially side by side, parallel positions, and positioned within the electrical insulator means in substantially side by side parallel positions, electrically conductive strip electrode having at least one male contact and at least two female contacts and connector element means including a combination of at least one electrically conductive male contact electrically connected to an electrically conductive female contact and at least one additional electrically conductive female contact which is electrically insulated from the combination and connectable to an electrically conducting lead means for connecting an accessory to each of the insulated conductive female contacts.

2. The vehicle fuse block extender of claim 1 wherein the strip element and connector element means have a "⊥" configuration.

3. The vehicle fuse block extender of claim 1 wherein the strip element and connector element means have a "Y" configuration.

4. The vehicle fuse b lock extender of claim 1 further including male contacts other than those for contact with the vehicle fuse block.

5. The vehicle fuse block extender of claim 1 further including polarity indicia.

* * * * *